US005819352A

United States Patent [19]

Bancroft et al.

[11] Patent Number: 5,819,352

[45] Date of Patent: Oct. 13, 1998

[54] MOUNT FOR MOTORIZED BROOM

[75] Inventors: Allen J. Bancroft, Elkhart; James N. Tierney, Wakarusa, both of Ind.

[73] Assignee: White Consolidated Industries, Inc., Cleveland, Ohio

[21] Appl. No.: 767,401

[22] Filed: Dec. 16, 1996

[51] Int. Cl.[6] ..... A47L 11/282; A47L 11/24

[52] U.S. Cl. ..... 15/52.1; 15/50.3; 15/82; 15/368

[58] Field of Search ..... 15/49.1, 50.2, 15/50.3, 52.1, 52.2, 79.2, 82, 97.1, 355, 368

[56] References Cited

U.S. PATENT DOCUMENTS 3,643,276 2/1972 Worwag .
4,555,989 12/1985 Marass et al. .
5,152,027 10/1992 La Boda .
5,231,725 8/1993 Hennessey et al. .
5,239,721 8/1993 Zahuranec .
5,390,387 2/1995 Dube et al. .
5,452,490 9/1995 Brundula et al. .

*Primary Examiner*—Randall E. Chin
*Attorney, Agent, or Firm*—Pearne, Gordon, McCoy & Granger LLP

[57] ABSTRACT

Disclosed is a brush mounting assembly for a brush utilized in an industrial sweeper. The mounting assembly enables the height of the brush to be easily adjusted while allowing independent action of each end of the brush. Furthermore, the assembly provides quick disconnect at each end of the brush so that the brush may be changed without the use of tools.

12 Claims, 5 Drawing Sheets

MOUNT FOR MOTORIZED BROOM

FIELD OF THE INVENTION

The present invention relates to an apparatus for adjusting the height of a motorized broom assembly utilized in industrial sweepers. The apparatus enables the broom height to be readily adjusted from the rear of the machine, while also allowing independent action of a brush utilized in the assembly. The apparatus also enables quick disconnect or release of a brush from the assembly.

BACKGROUND OF THE INVENTION

Industrial sweepers typically utilize an electric motor or internal combustion engine, a cylindrical brush for sweeping across the floor, an air blower and filter system for handling dust, a drive mechanism, and a power train for distributing power and controlling the drive wheel and brush.

Brush assemblies are known in which a cylindrical brush is oriented such that its axis of rotation is perpendicular to the direction of travel of the sweeper. As far as is known, none of these assemblies allow independent travel between opposite ends of the brush. Conventional broom assemblies are typically rotatably supported along a common axle. Upward displacement at one end of a broom assembly causes a corresponding movement at the other end of the assembly. This is undesirable since upward displacement of a broom assembly results in a decrease in sweeping effectiveness. Accordingly, there is a need for a brush assembly that provides for independent travel between opposite ends of a brush.

It would also be particularly desirable to provide a height adjustment mechanism that would enable the entire brush assembly to be easily and uniformly raised or lowered. Although satisfactory in many respects, conventional brush height adjustment mechanisms are often difficult to raise, and/or do not uniformly raise or lower the brush assembly.

Another disadvantage associated with currently known industrial sweepers pertains to changing the brush. Typically, changing a brush involves removing one or more mechanical components, typically side hubs, which require the use of tools. Such relatively complicated removal procedures increase the down time of the unit and thus increase cleaning and labor costs. Furthermore, the requisite tools must be stored on the sweeper unit, which in the case of using multiple sweeper units, increases the number of tool sets required. If the requisite tools are not stored on each sweeper unit, and instead stored in a central tool bin or storage location, then additional time is necessary for the operator to walk to that designated tool location, get the requisite tools, return to the sweeper unit, and after changing the brush, return the tools to the storage location. If two or more sweepers are being used at the same time and brushes must be changed at the same time, and if only one set of tools is available at the bin, brush changing for one of the sweeper units will have to wait until the other unit is changed. If the use of power tools is required, this operation is even more involved.

In view of the foregoing, it will be appreciated that there is a need for an apparatus providing easy adjustment of brush height in an industrial sweeper. Furthermore, there exists a need for a broom assembly enabling independent movement of opposite ends of a brush within the assembly. Moreover, there is a need for a quick disconnect mechanism enabling quick and simple removal of a brush, particularly which does not require tools.

SUMMARY OF THE INVENTION

The present invention achieves the aforementioned objectives and provides in one aspect, a brush mounting assembly comprising a frame, a pair of axles, a corresponding pair of brush mounting arms, each arm being releasably engaged to a respective axle, and a pair of transversely oriented adjusting rods in operable engagement with the axles.

In yet another aspect, the present invention provides a brush mounting assembly comprising a sweeper frame assembly, a pair of axles, a pair of pivotable arms for selectively adjusting the height of a cylindrical brush disposed between the arms, first and second levers projecting outward from a respective axle, and at least one adjusting rod in operable engagement with the levers.

DESCRIPTION OF THE PREFERRED EMBODIMENTS

Figure 1:
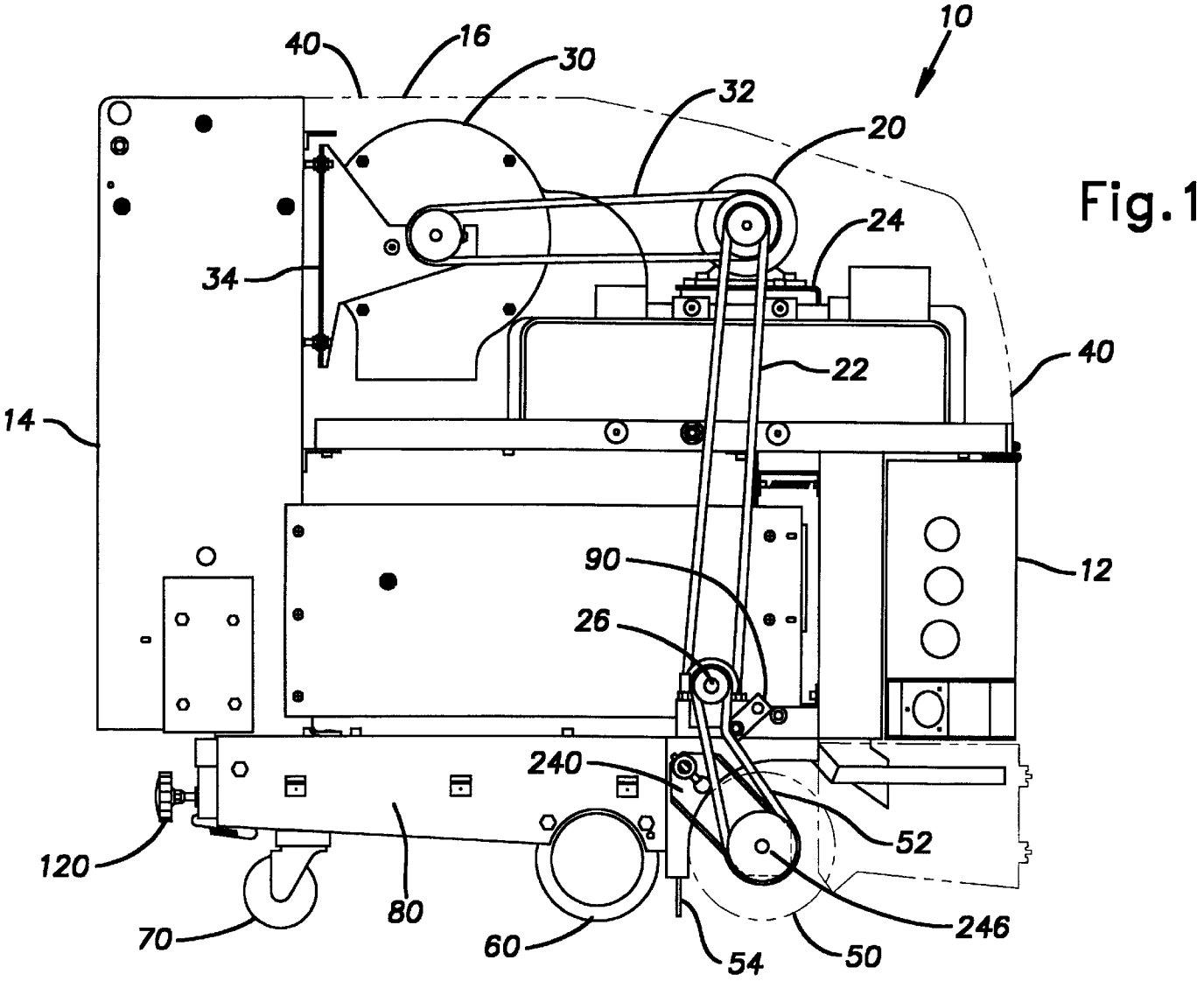
FIG. 1 is an elevational view of an industrial sweeper utilizing a preferred embodiment brush mounting assembly in accordance with the present invention.

FIG. 1 illustrates an industrial sweeper 10 utilizing a preferred embodiment brush mounting assembly in accordance with the present invention. The sweeper 10 has a front end 12, a rear end 14, and a top 16. The sweeper 10 comprises a motor 20, a blower 30, and an enclosure 40 generally disposed above and housing the motor 20 and the blower 30. The sweeper 10 further comprises a cylindrical brush 50, one or more drive wheels 60, and one or more follower wheels 70. The brush 50, the drive wheels 60, and the follower wheels 70, are typically affixed to an underframe 80 described in greater detail below. The motor 20 is affixed to a first mounting base 24. The blower 30 is affixed to a second mounting base 34, and receives rotary power from the motor 20 by a blower belt 32 as shown in FIG. 1. The motor 20 also distributes power to other components of the sweeper 10 such as the brush 50. Typically, an accessory drive belt 22 extends between the motor 20 and an accessory drive shaft 26 providing power takeoff for other components. The brush 50 is powered via a brush drive belt 52 extending between a brush drive pulley 246 in operative engagement with the brush 50 described in greater detail below, and the accessory drive shaft 26. One or more brush shields 54 may be provided around the periphery of the brush as known in the art. An adjustable belt tensioning assembly 90 is preferably provided that engages the brush drive belt 52 and maintains proper tension thereof.

Figure 2:
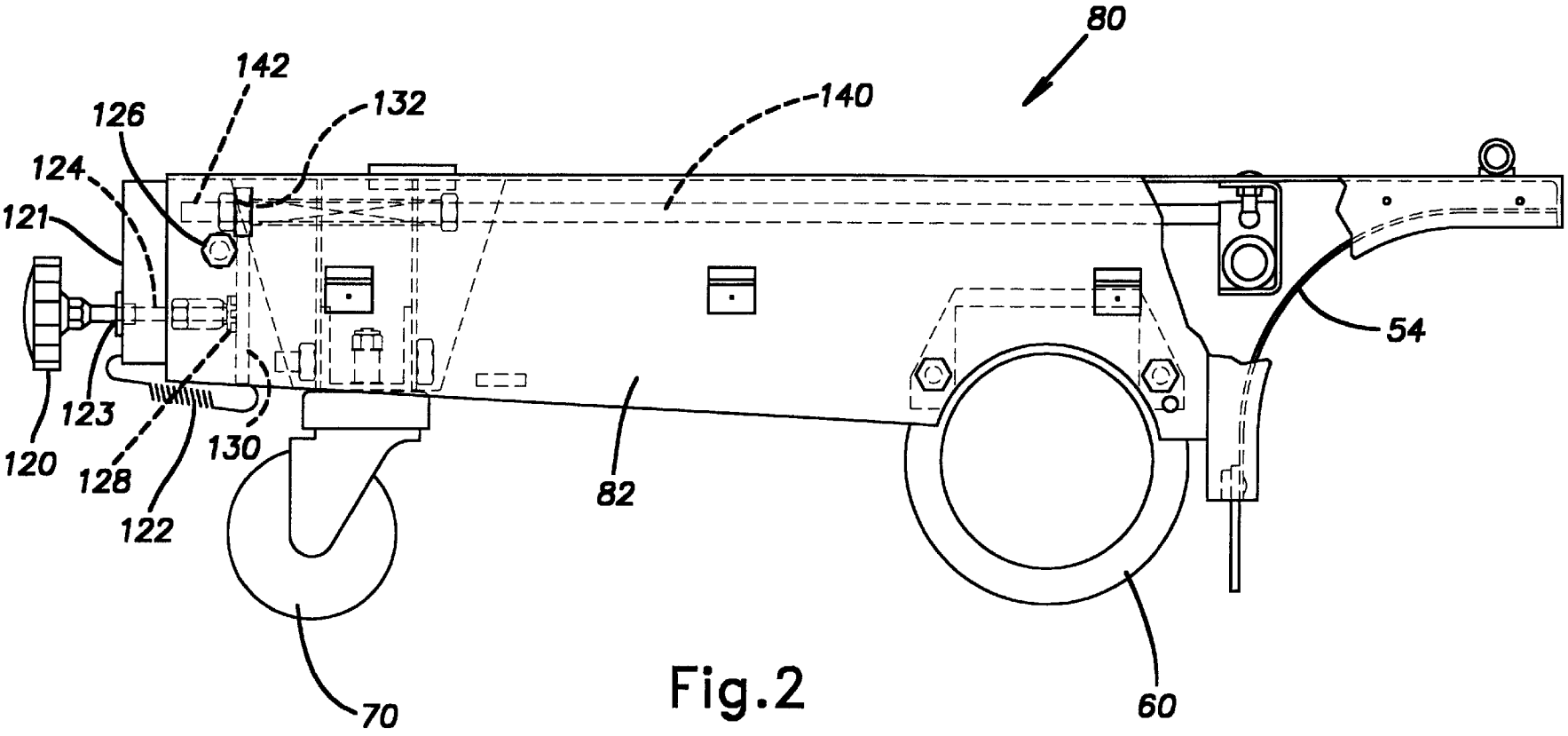
FIG. 2 is an elevational view of the underframe of the sweeper shown in FIG. 1, illustrating in greater detail the components of the preferred embodiment brush mounting assembly.
Figure 3:
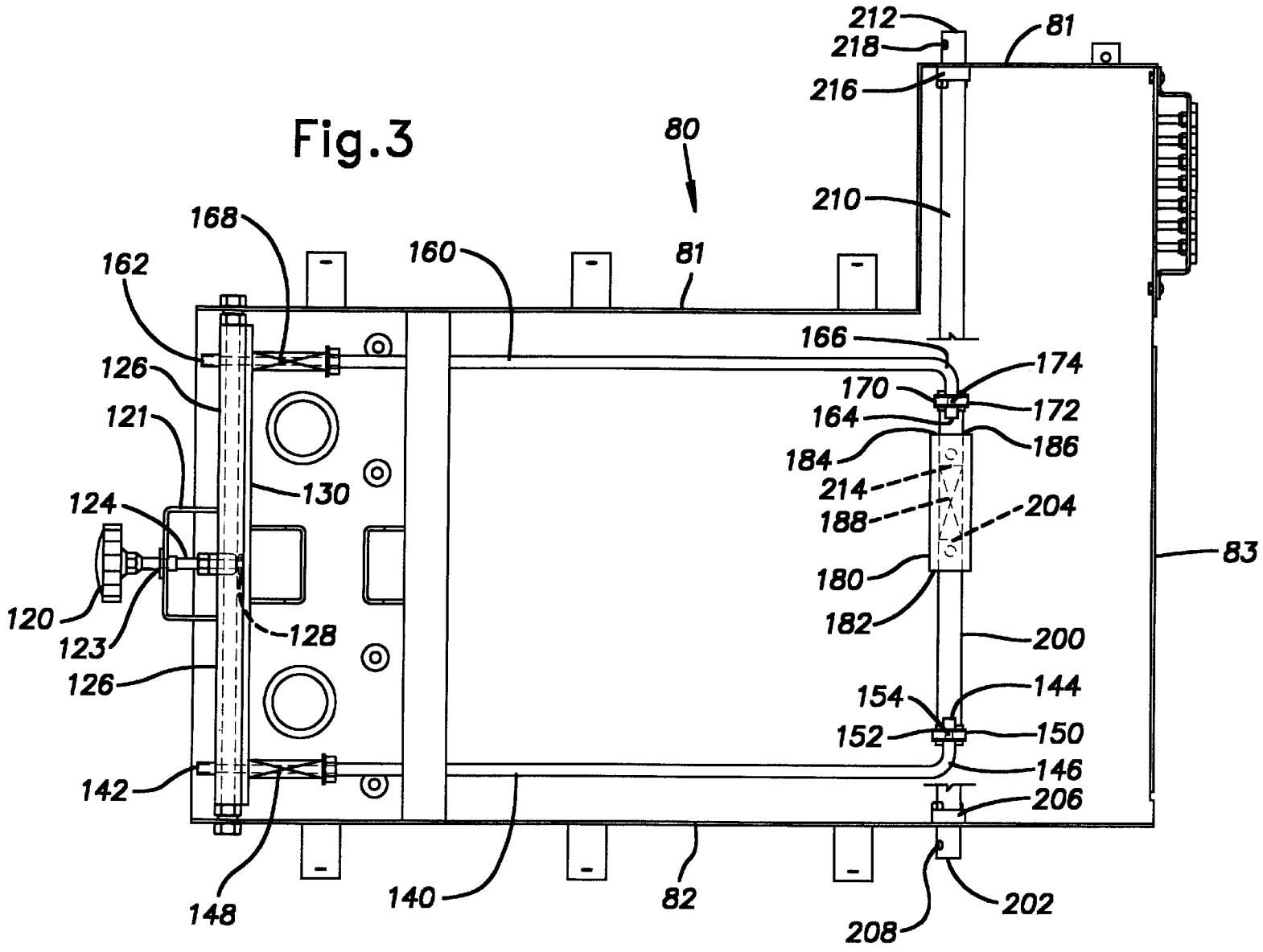
FIG. 3 is a plan view of the underframe depicted in FIG. 2, further detailing the components of the preferred embodiment brush mounting assembly.

Referring to FIGS. 2 and 3, the underframe 80 generally comprises a second side 81, a first side 82, and a transversely oriented front wall 83 extending between the first and second sides 81 and 82, respectively. The underframe 80 generally provides mounting surfaces for supporting and housing the preferred embodiment brush mounting assembly of the present invention. The preferred embodiment brush mounting assembly comprises a brush height adjusting assembly typically located toward the rear of the underframe 80. As shown in FIGS. 2 and 3, the brush height adjusting assembly includes a rotatable brush height adjuster 120 that is in operable engagement with a threaded adjuster shaft 124. A shaft receptacle 128 receives one end of the adjuster shaft 124. The threaded adjuster shaft 124 extends through a threaded aperture 123 defined in a fixed, stationary frame member 121. The frame member 121 may constitute a rear wall of the underframe 80. As will be understood, by rotating the adjuster 120 and the adjuster shaft 124, the end of the adjuster shaft 124 received within the shaft receptacle 128 is linearly displaced due to the action of the threaded length of the shaft 124 threadedly engaged within the aperture 123 defined in the fixed frame 121.

The shaft receptacle 128 is affixed to a movable, and more specifically, a pivotable, adjuster plate 130. The adjuster plate 130 contacts a fulcrum 126 about which the plate 130 pivots. Preferably, the fulcrum 126 is a horizontal rod extending across the width of the underframe 80. Accordingly, the adjuster plate 130 pivots about a generally horizontal axis. All references to the underframe 80 and the preferred embodiment brush height adjusting assembly are made with respect to the underframe 80 and assembly when incorporated in a sweeper unit. As best shown in FIG. 2, it will be understood that as the brush height adjuster 120 is rotated thereby causing linear movement at the end of the shaft 124 within the shaft receptacle 128, the adjuster plate 130 is pivoted about the fulcrum 126. This action causes linear movement along the upper periphery of the plate 130 at the location where a pair of rods 140 and 160, described in greater detail below, engage the plate 130. A spring 122 is disposed between the stationary frame member 121 and the adjuster plate 130 to maintain engagement between the distal end of the shaft 124 and the receptacle 128 affixed to the plate 130. The spring 122 urges the plate 130 against the distal end of the shaft 124 to ensure that changes in the linear position of the shaft 124 are reflected in the rotary position of the plate 130.

Referring to FIG. 3, the preferred embodiment brush mounting assembly further comprises a first rod 140 and a second rod 160, both extending longitudinally within the underframe 80. Each rod 140 and 160 is in operable engagement with the plate 130 at the rear of the underframe 80 and extends toward the front wall 83 of the underframe 80. Disposed proximate to the front end of each rod 140 and 160 is a lever assembly that engages a respective rod with a transversely oriented axle 200 or 210, described in greater detail below.

The first rod 140 has a rear end 142 engaged with the plate 130. The rod 140 also has an arcuate portion 146 proximate a front end 144 as shown in FIG. 3. Preferably disposed near the rear end 142 of the rod 140 is a spring 148. Similarly, the rod 160 has a rear end 162 in engagement with the plate 130, a front end 164, an arcuate portion 166 disposed near the front end 164, and a spring 168 preferably located near the rear end 162. The springs 148 and 168 are sized and selected to provide, or at least assist in providing, a bias position for the brush height adjusting mechanism. The springs 148 and 168 also serve to dampen any displacement, vibration, or other unwanted movement of the rods 140 and 160 during operation of the sweeper, such as typically resulting from an uneven floor or striking an upwardly projecting obstacle with the brush.

The first rod 140 is operably engaged with the first axle 200 by a lever projection 150 extending radially outward from the first axle 200. The lever projection 150 provides an aperture 154 through which extends the front end 144 of the rod 140. A lever bushing 152 may be used between these components, i.e. the front end 144 of the rod 140 and the inside surface of the aperture 154 to facilitate engagement and motion between these components. Similarly, the second rod 160 is operably engaged with the second axle 210 by a lever projection 170 extending radially outward from the second axle 210. An aperture 174 is defined in the lever projection 170 through which extends the front end 164 of the rod 160. A lever bushing 172 may also be utilized.

Each axle 200 and 210 is rotatably supported within the underframe 80. Preferably, the first axle 200 has an outer end 202 rotatably supported within the first side 82 of the underframe 80 by use of a collar 206. The first axle 200 also has an inner end 204 that is received within and retained by a sleeve 180. The second axle 210 has an outer end 212 that is rotatably supported by the underframe 80, and preferably by the second side wall 81. The second axle 210 may comprise a collar 216. The second axle 210 has an inner end 214 that is received by and retained within the sleeve 180. The sleeve 180 is preferably a generally cylindrical hollow component providing access from a first sleeve end 182 to a second sleeve end 184 and defining a receiving interior 186 to slidably accommodate the inner ends 204 and 214 of the axles 200 and 210, respectively. The sleeve 180 also retains a spring 188, preferably disposed between the inner ends 204 and 214 of the axles 200 and 210. The spring 188 functions to absorb any displacement, vibration, or other unwanted movement of the axles 200 and 210. The spring 188 also serves to isolate the first axle 200 from the other second axle 210. Disposed at each outer end of an axle, and releasably engaged therewith, is a brush height adjusting arm described in greater detail below.

Figure 4:
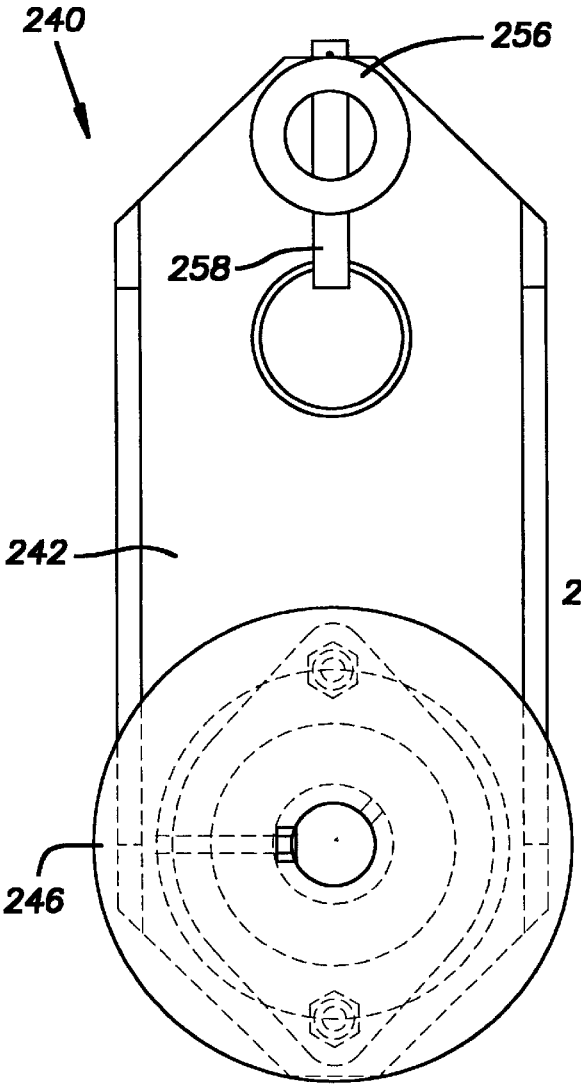
FIG. 4 is a front elevational view of a brush height adjusting arm component utilized in the preferred embodiment brush mounting assembly.
Figure 5:
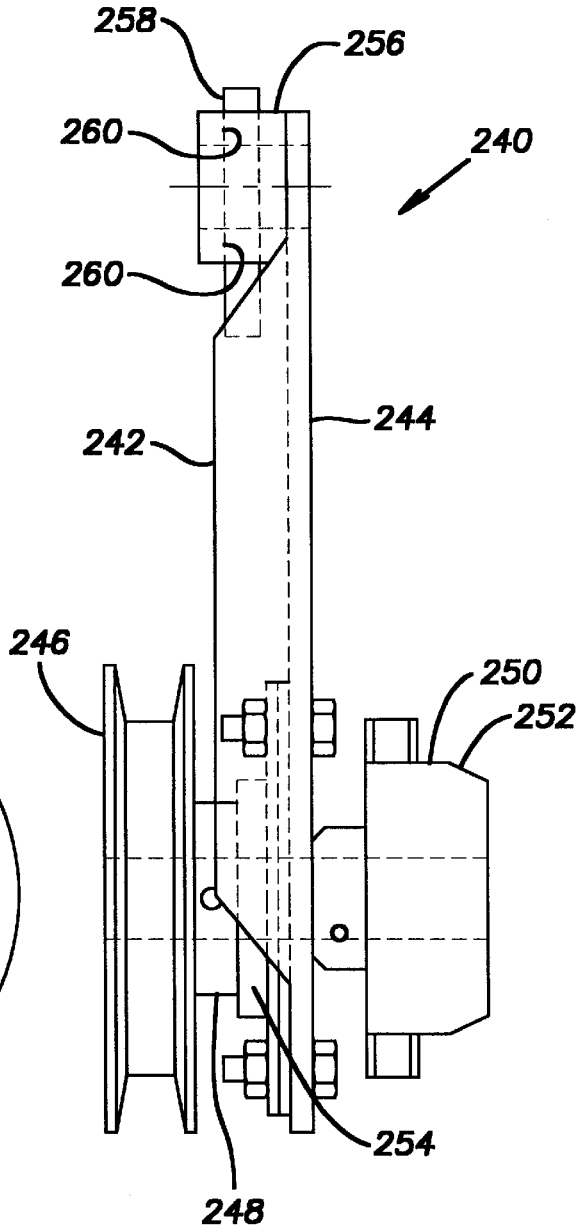
FIG. 5 is a side elevational view of the brush height adjusting arm component shown in FIG. 4.

FIGS. 4 and 5 illustrate a preferred embodiment brush height adjusting arm 240. The preferred embodiment arm 240 comprises an axle collar 256 that releasably engages an outer end of a previously described axle 200 or 210. The axle collar 256 is disposed over a passage defined through the thickness of the arm 240. The passage is sized to accommodate and receive an end of an axle, preferably the outer end of an axle such as the outer ends 202 and 212 of the axles 200 and 210, respectively. The preferred embodiment arm 240 comprises an outer face 242, an inner face 244, a rotatable drive pulley 246, a rotatable shaft 248 extending between the faces 242 and 244, and a drive hub 250. The drive pulley 246 is preferably disposed proximate the outer face 242 and in operable engagement with the shaft 248. The drive hub 250 is preferably disposed near the inner face 244 and in operable engagement with the shaft 248. The shaft 248 is rotatably supported by one or more bearings 254. The drive hub 250 provides a hub receiving face 252 for receiving and retaining an end of a cylindrical brush as known in the art. The receiving face 252 may provide one or more projections or keys to engage an end of a brush, which typically has a recessed or keyed drive end. The axle collar 256 is a tubular projection extending outward from the outer face 242 of the arm 240. The collar 256 receives an outer end 202 or 212 of an axle 200 or 210, respectively. The axle collar 256, and thus the arm 240, is releasably engaged with an end of an axle 200 or 210 by the use of a retaining pin 258 which extends through oppositely located collar apertures 260 and which also extends through apertures defined in the outer end of the axles such as, referring to FIG. 3, axle aperture 208 or axle aperture 218.

Figure 6:
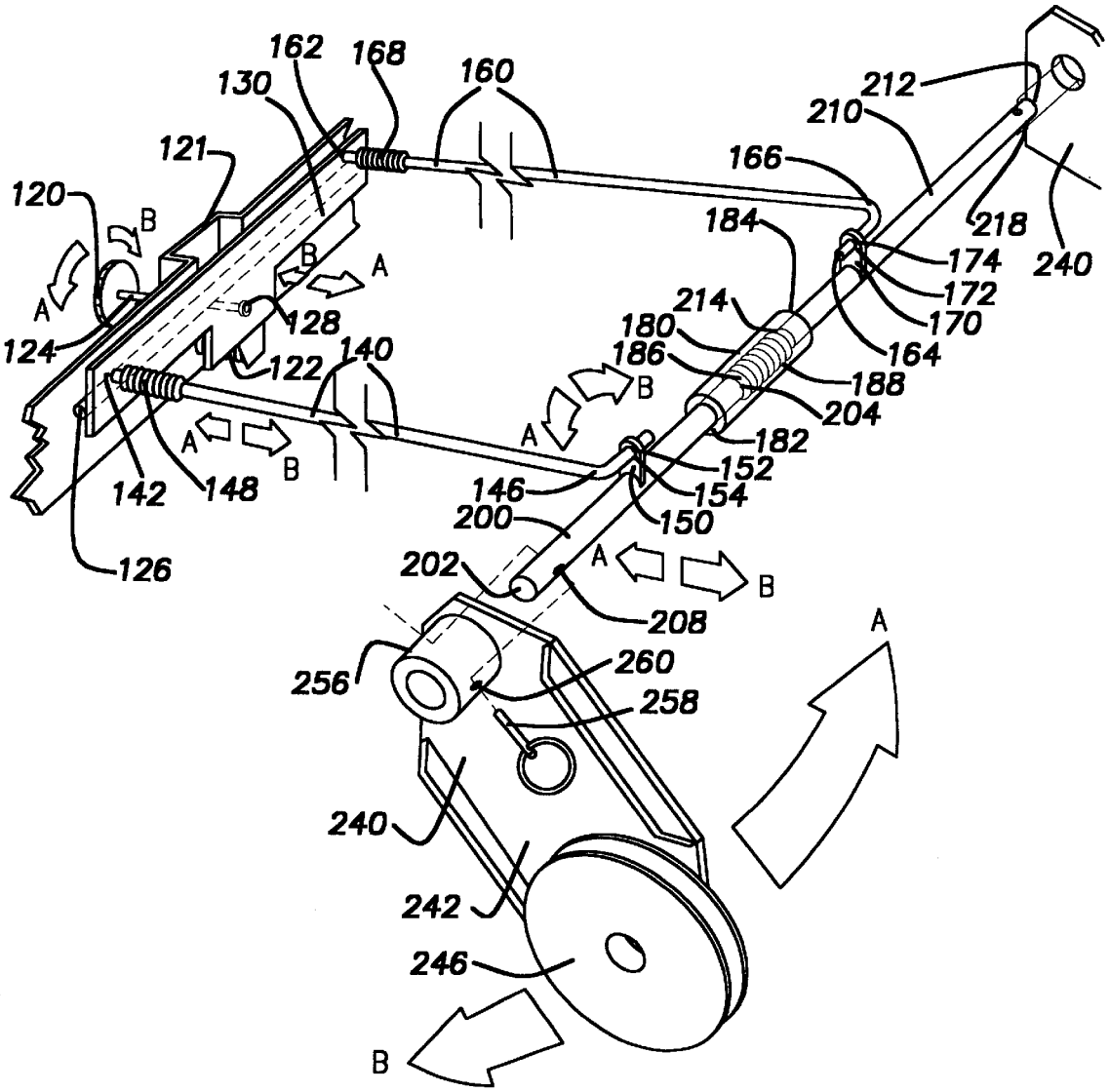
FIG. 6 is a partially exploded view of the preferred embodiment brush mounting assembly, illustrating its operation and engagement with a pair of brush height adjusting arms.

Referring to FIG. 6, it will be understood that in the assembled preferred embodiment brush mounting assembly, a cylindrical brush is disposed generally in front of and below the axles 200 and 210, and oriented generally parallel with those axles. Preferably, the brush is also disposed between a pair of brush height adjusting arms 240. One of the two arms 240 provide a drive pulley 246 that is in operable engagement with the accessory drive shaft 26 and thus the motor 20. It is within the scope of the present invention to utilize drive pulleys 246 on both arms 240, each on an opposite end of a brush. A "passive" arm may be used, identical to the arm 240 illustrated in FIGS. 4 and 5, except it does not utilize a drive pulley 246. Instead, the hub 250 is rotatably supported by the shaft 248, without a drive pulley 246.

The brush height adjusting arm 240 enables a brush to be easily and quickly replaced or reversed without the use of tools. All that is necessary to replace a brush is to remove the retaining pin 258 from the collar 256, and specifically, from the collar apertures 260. That enables the arm 240 to freely pivot about the axle 200 or 210 extending in the collar 256. The arm 240, will in most instances, pivot due to the tension of the drive belt 52 and/or the belt tensioning assembly 90. Release, or at least partial release, of tension on the drive belt 52 will enable the arm 240 to be separated from the end of the brush. Upon such separation, the brush may be removed for subsequent replacement or reversal.

Referring to FIG. 6, the operation of the preferred embodiment brush mounting assembly is as follows. As previously explained, the assembly is generally disposed within the underframe 80 of the sweeper 10. A cylindrical brush 50 is disposed between the pair of brush height adjusting arms 240, and specifically, such that one end of the brush 50 is proximate to a drive pulley 246 on one of the arms 240. Brush height is adjusted by rotating the arms 240 about an axis extending along the axles 200 and 210. The brush is lowered by rotating the arms 240 in the direction of arrow B. Similarly, the brush is raised by rotating the arms 240 in the direction of arrow A.

The arms 240 are rotated, along with the axles 200 and 210, by rotating the brush height adjuster 120 shown on the left-hand side of FIG. 6. When the adjuster 120 is rotated, for instance in the direction of arrow A to raise the brush, the threaded shaft 124 is linearly displaced with respect to the fixed frame member 121. The end of the shaft 124 retained within the receptacle 128 causes pivotal movement of the plate 130 about the fulcrum 126. Specifically, rotary movement at the adjuster 120 in the direction of arrow A causes substantially linear movement along the bottom periphery of the plate 130 in the direction of arrow A, i.e. toward the front of the unit. As will be understood, such movement at the bottom of the plate is reversed at the upper periphery of the plate 130. Accordingly, the rods 140 and 160 both move rearward in the direction of arrow A. Linear movement of the rods 140 and 160 is translated-to rotary movement of the axles-200 and 210 at each lever assembly. The axle 200 is rotated in the direction of arrow A due to the rearward linear movement of the rod 140 at the lever projection 150. Similarly, the axle 210 is also rotated due to the linear movement of the rod 160 at the lever projection 170. The rotary movement of each axle causes rotary movement of each arm 240 coupled at each end of the respective axle.

Although the present invention has been described in terms of an industrial sweeper, it is to be understood that the preferred embodiment brush mounting assembly could be utilized in other devices having rotating components that must be adjustable between various positions.

The present invention brush mounting assembly significantly reduces the degree of transverse displacement along the length of a brush assembly. That is, linear movement at one end of the brush assembly, such as resulting from an uneven floor surface or striking an upwardly projecting obstacle, is generally not transmitted to the other end of the brush assembly. This action is believed to result from the use of pivoting brush height adjusting arms, multiple axles, and a plurality of springs in conjunction with an axle retaining sleeve. This assembly provides for independent travel between opposite ends of a brush.

The present invention broom assembly enables a brush to be easily and quickly removed without the use of tools. This feature is particularly attractive when incorporated in an industrial sweeper and overcomes the numerous disadvantages noted herein.

Furthermore, the present invention provides a height adjustment apparatus that enables a brush assembly to be easily and readily raised or lowered from a remote location, such as the rear of an industrial sweeper. The apparatus uniformly raises or lowers the brush assembly due to the combined action of the adjuster plate 130, a pair of rods in operable engagement with a corresponding pair of axles, and the noted pivotable arms.

While the foregoing details what is felt to be the preferred embodiment of the invention, no material limitations to the scope of the claimed invention is intended. Further, features and design alternatives that would be obvious to one of ordinary skill in the art are considered to be incorporated herein. The scope of the invention as set forth is particularly described in the claims hereinbelow.

What is claimed is:

1. A brush mounting assembly comprising:

a frame;

a first axle rotatably supported by said frame, said first axle having an inner end and an outer end;

a second axle rotatably supported by said frame, said second axle having an inner end and an outer end;

a first brush mounting arm releasably engaged to said outer end of said first axle, said first arm being adapted to engage an end of a brush;

a second brush mounting arm releasably engaged to said outer end of said second axle, said second arm being adapted to engage an end of a brush;

a first adjusting rod transversely oriented with respect to said first axle and having an end in operable engagement with said first axle, wherein linear movement of said first adjusting rod along the longitudinal axis of said first adjusting rod causes rotary movement of said first axle; and a second adjusting rod transversely oriented with respect to said second axle and having an end in operable engagement with said second axle, wherein linear movement of said second adjusting rod along the longitudinal axis of said second adjusting rod causes rotary movement of said second axle.

2. The assembly of claim 1 further comprising:

a sleeve having a first end and a second end and defining a hollow interior extending between said first end and said second end of said sleeve, wherein said inner end of said first axle and said inner end of said second axle are disposed within said interior of said sleeve.

3. The assembly of claim 2 further comprising:

a spring disposed within said interior of said sleeve and between said inner end of said first axle and said inner end of said second axle.

4. The assembly of claim 1 further comprising:

a rotatable adjuster having a threaded shaft and a distal end, said shaft threadedly engaged within an aperture defined in said frame;

a pivotable member retained by said frame; and a receptacle for receiving said distal end of said shaft, said receptacle affixed to said pivotable member, wherein rotation of said adjuster causes said receptacle to move and thereby pivot said member.

5. The assembly of claim 4 wherein said first adjusting rod and said second adjusting rod are in operable engagement with said pivotable member.

6. The assembly of claim 1 wherein said first brush mounting arm comprises:

an arm member having a first end and a second end;

a passage defined through the thickness of said arm member and proximate said first end, said passage sized to accommodate said outer end of said first axle;

a tubular axle collar affixed to said arm member and generally aligned with said passage;

a rotatable shaft extending through the thickness of said arm and disposed proximate said second end of said arm;

a drive pulley in operable engagement with said shaft; and a drive hub in operable engagement with said shaft.

7. The assembly of claim 6 wherein said tubular axle collar has a pair of opposing collar apertures defined in the walls of said collar, and said outer end of said first axle defines an axle aperture extending through the thickness of said first axle, said outer end of said first axle extending through said passage defined in said arm member and further into said tubular axle collar such that said pair of collar apertures are aligned with said axle aperture.

8. The assembly of claim 7 wherein said assembly further comprises a retaining pin extending through said pair of collar apertures and through said axle aperture.

9. A brush mounting assembly comprising:

a sweeper frame assembly;

a pair of axles rotatably supported within said frame assembly, wherein each of said axles provides an outer end, a pair of pivotable arms for selectively adjusting the height of a cylindrical rotatable brush disposed between said pair of arms, each of said arms being in operable engagement with a respective one of said axles;

a first lever projecting outward from one of said axles;

a second lever projecting outward from another of said axles; and at least one adjusting rod in operable engagement with said first and second levers, wherein upon linear displacement of said adjusting rod, said first and second levers are pivoted, thereby causing rotary displacement of said pair of axles, resulting in pivotal movement of said pair of arms, whereby said height of said brush is changed.

10. The assembly of claim 9 wherein said pair of axles are oriented along a common longitudinal axis and each of said axles further provides an inner end opposite said outer end, said inner ends of said axles being disposed proximate to one another, said assembly further comprising:

a tubular sleeve having a hollow interior, said inner ends of said axles disposed in said sleeve interior.

11. The assembly of claim 9 further comprising:

a threaded adjusting shaft extending through and in operable engagement with a threaded aperture defined in said sweeper frame assembly, said shaft having a distal end;

a pivotable adjusting plate in operable engagement with said distal end of said shaft and said at least one adjusting rod, whereby rotation of said shaft causes linear displacement of said shaft through said aperture, thereby pivoting said adjusting plate and effecting linear displacement of said at least one adjusting rod.

12. The assembly of claim 9 wherein one of said pivotable arms comprises a rotatable drive pulley adapted for powering said brush.

* * * * *